US006932293B1

(12) United States Patent
Schmodde et al.

(10) Patent No.: US 6,932,293 B1
(45) Date of Patent: Aug. 23, 2005

(54) THREAD-SUPPLYING DEVICE FOR TEXTILE MACHINES

(75) Inventors: Herman Schmodde, Horb-Dettlingen (DE); Richard Kaufmann, Freudenstadt (DE); Gunter Leopold, Baiersbronn (DE)

(73) Assignee: Memminger-IRO GmbH, Dornstetten (DE)

( * ) Notice: Subject to any disclaimer, the term of this patent is extended or adjusted under 35 U.S.C. 154(b) by 0 days.

(21) Appl. No.: 10/030,790

(22) PCT Filed: Jul. 7, 2000

(86) PCT No.: PCT/DE00/02228

§ 371 (c)(1),
(2), (4) Date: Mar. 29, 2002

(87) PCT Pub. No.: WO01/04402

PCT Pub. Date: Jan. 18, 2001

(30) Foreign Application Priority Data

Jul. 12, 1999 (DE) ..... 199 32 481

(51) Int. Cl.[7] ..... B65H 51/02
(52) U.S. Cl. ..... 242/365.6; 66/132 R
(58) Field of Search ..... 242/364, 365.6; 66/132 R, 132 T

(56) References Cited

U.S. PATENT DOCUMENTS 3,999,717 A * 12/1976 Jacobsson ..... 242/365.6
4,227,657 A * 10/1980 Simin et al. ..... 66/132 R
4,290,565 A * 9/1981 Smith ..... 242/152.1
4,598,560 A * 7/1986 Sawazaki ..... 66/132 T
4,673,139 A * 6/1987 Memminger et al. ..... 66/132 R
4,754,936 A * 7/1988 Dalmau Guell et al. .. 66/132 R
5,156,079 A * 10/1992 El-Shiekh et al. ..... 87/57
5,590,547 A * 1/1997 Conzelmann ..... 66/132 R
5,716,024 A * 2/1998 Kaufmann et al. ..... 66/132 T
5,782,424 A * 7/1998 Horvath et al. ..... 242/365.6
5,860,298 A * 1/1999 Chen ..... 66/132 T

FOREIGN PATENT DOCUMENTS

DE 4413757 A1 * 10/1994
FR 1 029 525 3/1953

OTHER PUBLICATIONS

Memminger-IRO GmbH, Operating instructions for Mer 2; 1997.
Photos of Memminger Elastane Roller Mer 2-Standard; taken Mar. 1, 2004.

* cited by examiner

*Primary Examiner*—John M. Jillions
(74) *Attorney, Agent, or Firm*—Leydig, Voit & Mayer, Ltd.

(57) ABSTRACT

The yarn feeder having a plastic housing, preferably made of two clamshells, with a plastic fastening device for connecting the yarn feeder to a retaining device of a textile machine. The fastening device is made rigid by suitable shaping and without the necessity for metal inlays. The two clamshell halves of the housing each have a bearing for a continuous shaft, which on one end carries a yarn guide drum and on its other end carries pulleys for a drive device. Fasteners serve to hold the two housing parts together in the correct position for enabling easy opening of the housing for maintenance.

13 Claims, 13 Drawing Sheets

THREAD-SUPPLYING DEVICE FOR TEXTILE MACHINES

FIELD OF THE INVENTION

The invention relates to a yarn feeder [having the characteristics of the preamble to claim 1, 2 or 3].

BACKGROUND OF THE INVENTION

Yarn feeders commonly are vendor supplied parts or accessories for textile machines and particularly in loop-forming textile machines are often found in great numbers thereon. The yarn feeders each feed one yarn to a yarn-using station, such as a knitting station. The quality of the knitted goods produced depends decisively on the precision and reliability of the yarn feeders. On the one hand, this demands precision-manufactured yet on the other hand, the yarn feeders should be as simply embodied, economical, and simple to make and maintain as possible. Furthermore, they must perform reliably even if operated for relatively long periods without special maintenance and in particular without cleaning. Deposits of dust or fluff must not impair operation.

The goal also is to design a yarn feeder such that it can be adapted in a simple way to different kinds of use.

In the industry, yarn feeders are known that have a metal housing, which on one end has a clamping device for fastening to a yarn-using machine, such as a knitting machine. The housing forms a retainer for two ball bearings, which are disposed on the side of the housing remote from the fastening device. The ball bearings rotatably support a vertically disposed shaft, which on its lower end has a yarn guide drum and on its upper end has one or more toothed-belt pulleys. The toothed-belt pulleys can be coupled to the shaft via a displaceable coupling disk.

A yarn brake and a plurality of yarn guide elements are disposed upstream of the yarn guide drum. Further yarn guide elements are disposed downstream of the yarn guide drum. In addition, a shutoff lever and a yarn feeler lever are pivotably supported on the housing and actuate switches disposed in the interior of the housing in order to indicate a yarn break and to shut off the textile machine if necessary. For contacting a suitable electric line, connection means are provided on the fastening device, from which means electric lines lead to the appropriate switches in the interior of the housing. A signal light also is disposed on the yarn feeder and signals an error state accordingly.

Such yarn feeders have proven themselves in practice. However, they can be expensive to manufacture.

OBJECTS AND SUMMARY OF THE INVENTION

It is an object of the invention to provide a reliably operable yarn feeder that can be more simply and economically produced.

The invention is carried out by a yarn feeder which has a plastic housing with a fastening clamp specially designed to withstand clamping forces.

The special design of the fastening clamp permits the clamp to have a narrow profile with the required stiffness and strength that retaining devices can be mounted on a retaining ring of a textile machine without the fastening clamps being a hindrance to each other. To that end, the invention provides on the one hand the possibility of embodying a jaw-like clamp on or in a box-like housing portion. Alternatively, the jaw-like clamp can be provided with reinforcement ribs on its side pointing away from the jaw, which also furnish the desired strength if they extend upwardly sufficiently, or in other words away from the retaining ring of the textile machine. On the textile machines, the spacing between the retaining ring and a drive belt for driving the yarn feeders is usually structurally specified by the construction. It has been found that the reinforcing ribs are adequately large if, viewed from the retaining ring, they protrude past the plane defined by the lower edge of the belt. In this way, it becomes possible for yarn feeders with the yarn guide drum, which are used to feed the yarns, for instance to knitting stations of a circular knitting machine and which must be relatively narrow in structure, to be formed of plastic with the housing of the fastening clamp. The significant forces that can be incurred by yarn feeders by the revolving drive belt are thus reliably absorbed and dissipated.

The yarn feeder, more particularly, may have a housing with at least 2 housing parts, each of which has a respective bearing means for the continuous shaft. Thus both housing parts, embodied in clamshell fashion, jointly conduct the incident support forces of the bearing means to the fastening device and thus to the textile machine, which acts as a stationary bearing for the yarn feeder. This in turn makes it possible to divide the housing over a large area so that in the dismantled state, unhindered access to the housing interior is possible. Once the two housing parts are put together, they are joined correctly by a connecting means, and as a result the housing is closed. Assembly is relatively quite uncomplicated. The dividing seam between the housing parts preferably is disposed substantially horizontally or slightly inclined, so that at least outside the fastening device, it extends along the side faces of the housing. This makes the interior of the housing parts easily accessible. During assembly, parts to be disposed in the interior can simply be introduced into it. This further simplifies assembly.

As bearing means, ball bearings are preferably provided, which are received in appropriate bearing seats of the housing parts. For bearing seats, tubular extensions can for instance be provided, which are formed on the housing parts and extend outward away from them. The ball bearings are preferably introduced from outside into the bearing seats. In a preferred embodiment, the lower bearing seat, toward the yarn guide drum, extends into the yarn guide drum. This maximizes the spacing between the two ball bearings, resulting in good support of the shaft with little play. To drive the shaft and the yarn guide drum, a plurality of toothed-belt pulleys or other kinds of pulleys can be disposed on the other end of the shaft as needed, with a belt traveling along the pulleys. The resultant support forces on the ball bearing are readily absorbed by a wide support spacing. Also by means of the bearing seat extending into the yarn guide drum, in the event of an error a yarn will not be wound onto the shaft, and this increases the operational safety.

The upper bearing seat can extend into the inside of a pulley, in order to maximize the spacing from the lower bearing seat as much as possible. In this case, both bearing seats are located outside the housing; the tubular extensions protrude upward and downward away from the housing.

In an advantageous embodiment, bearing receiving elements of elastomer are disposed in the bearing seats. These bearing receiving elements secure the ball bearings in the bearing seat. The bearing seats, on their inside face which is otherwise for instance cylindrical, are preferably provided with longitudinal ribs, which press into the bearing receiving elements. This provision makes it possible to press the bearings into the bearing seats with only slight axial forces and to secure them permanently there. This is true in particular even if the dimensions of the bearing seat should change or fluctuate somewhat because of production variations or temperature changes and aging.

The fastening device on the machine is formed for instance by a jaw-like clamp, which is embodied on at least one of the housing parts. The housing parts preferably, however, fit over one another in the region or the fastening device, so that each housing part and thus each bearing seat is joined to the fastening device in a way that directly transmits force. This makes possible good absorption of the retaining forces by the housing and good transmission of the support forces to the fastening device and the retaining device. To reinforce this, the housing parts in one embodiment are joined together in the region of the fastening device by at least one support means. The jaw of the fastening device can then be embodied such that on one side, one housing part has a bearing and clamping face, while on the opposite flank or side the other housing part defines the bearing and clamping face. As a result, when the fastening device is clamped firmly by means of a clamping screw that is braced on one leg and disoriented perpendicular to the clamping face, both housing parts are braced against one another.

A coupling device for fastening at least one further housing part may be embodied or provided on the housing. As a result, additional elements can be secured to the housing, which makes the yarn feeder even more versatile. The coupling device is preferably a clamp coupling with a guide that can be tightened.

In a preferred embodiment, the housing parts are embodied as electrically insulating, at least on their inside. Preferably, however, the housing is made either entirely or in part of plastic. This affords the possibility of placing electrical conductor tracks, as metal elements, in suitable receptacles of the housing without special insulation. The metal elements can perform a dual function, by acting at the same time as bearings for other common moveable elements, such as electric switches, shutoff means, yarn feelers, or the like.

If the yarn feeder housing is made of plastic, then possible electrostatic charges, which the running yarn sliding along the yarn guide elements could cause, can be counteracted by grounding of at least one, preferably stationary yarn guide element. Thus fluff deposits can be reduced, and other harmful effects of static charges can be reduced or prevented. The grounding can be done by means of an electric conductor connected to ground and disposed in the housing, if this conductor is connected to at least one element that is electrically conductive and is in contact with the yarn. The plastic housing can comprise entirely insulating material or electrically weakly conductive plastic.

Other objects and advantages of the invention will become apparent upon reading the following detailed description and upon reference to the drawings, in which:

Figure 1:
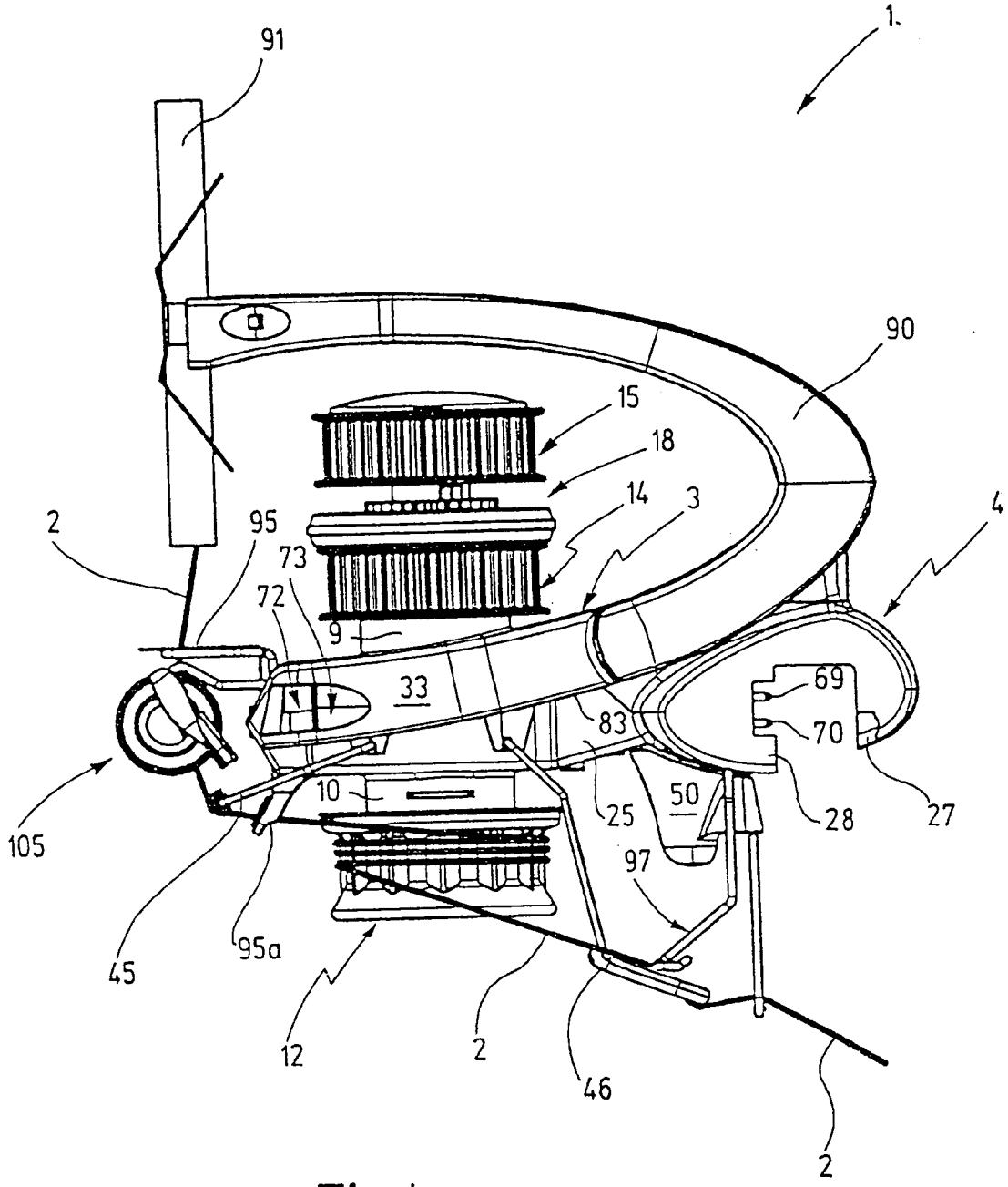
FIG. 1 is a side elevational view of an illustrative yarn feeder embodying the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF PREFERRED EMBODIMENTS

Figure 2:
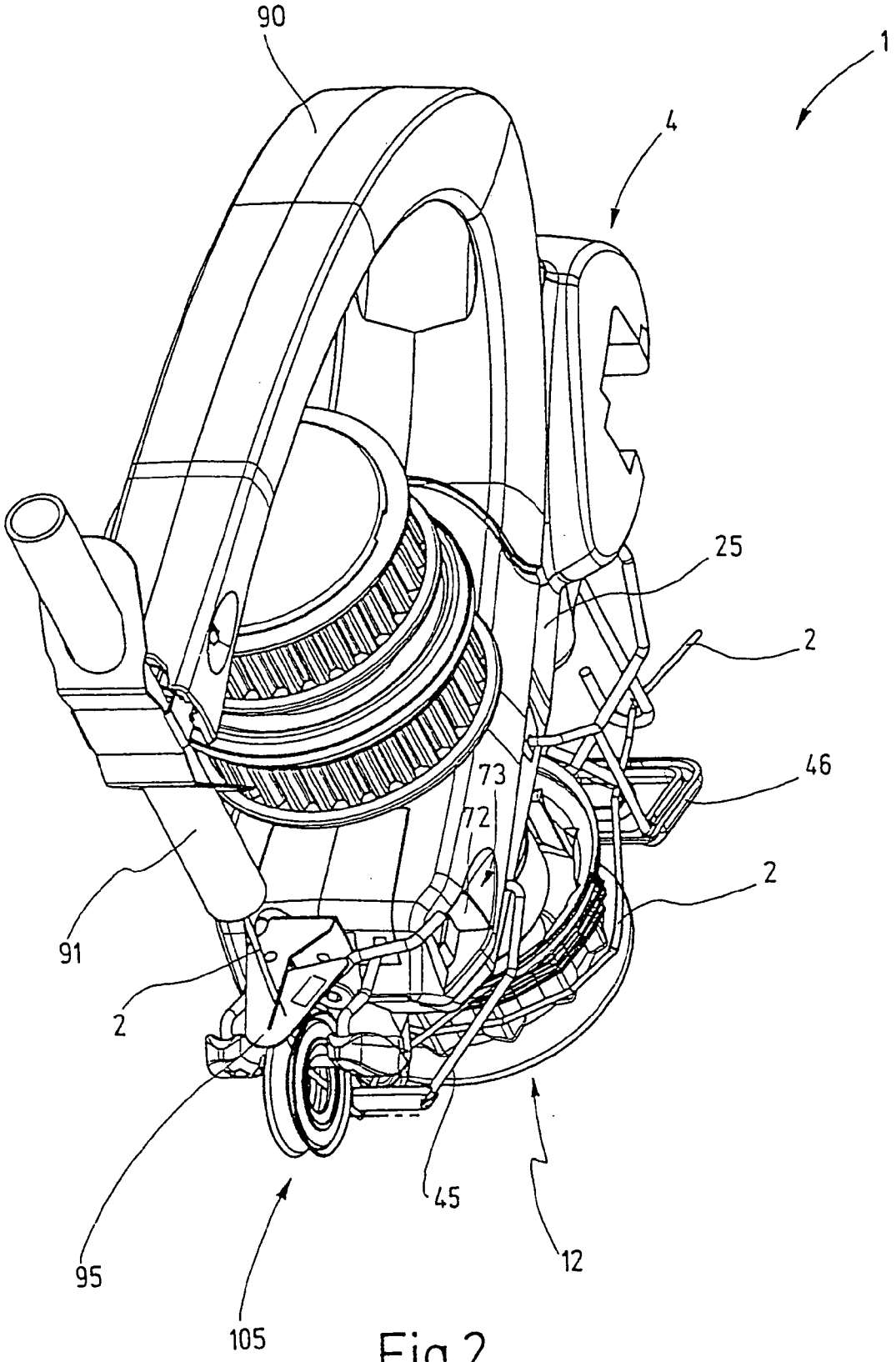
FIG. 2 is an enlarged perspective of the yarn feeder shown in FIG. 1.

Referring now more particularly to FIGS. 1 and 2 of the drawings, there is shown an illustrative yarn feeder 1 embodying the present invention adapted for feeding a yarn 2 to a textile-processing machine, such as a knitting machine. The yarn feeder 1 has a housing 3, which serves as a basic carrier for all the elements of the yarn feeder 1. On one end, the housing 3 is provided with a fastening device 4, which is arranged to support and secure the yarn feeder 1 on a suitable retainer 5, such as a rail or a ring of the textile machine. As depicted, the ring may have a rectangular cross section and an electric connection cable laid along its outside. A belt 5*a* serves to drive all the yarn feeders 1.

Figure 5:
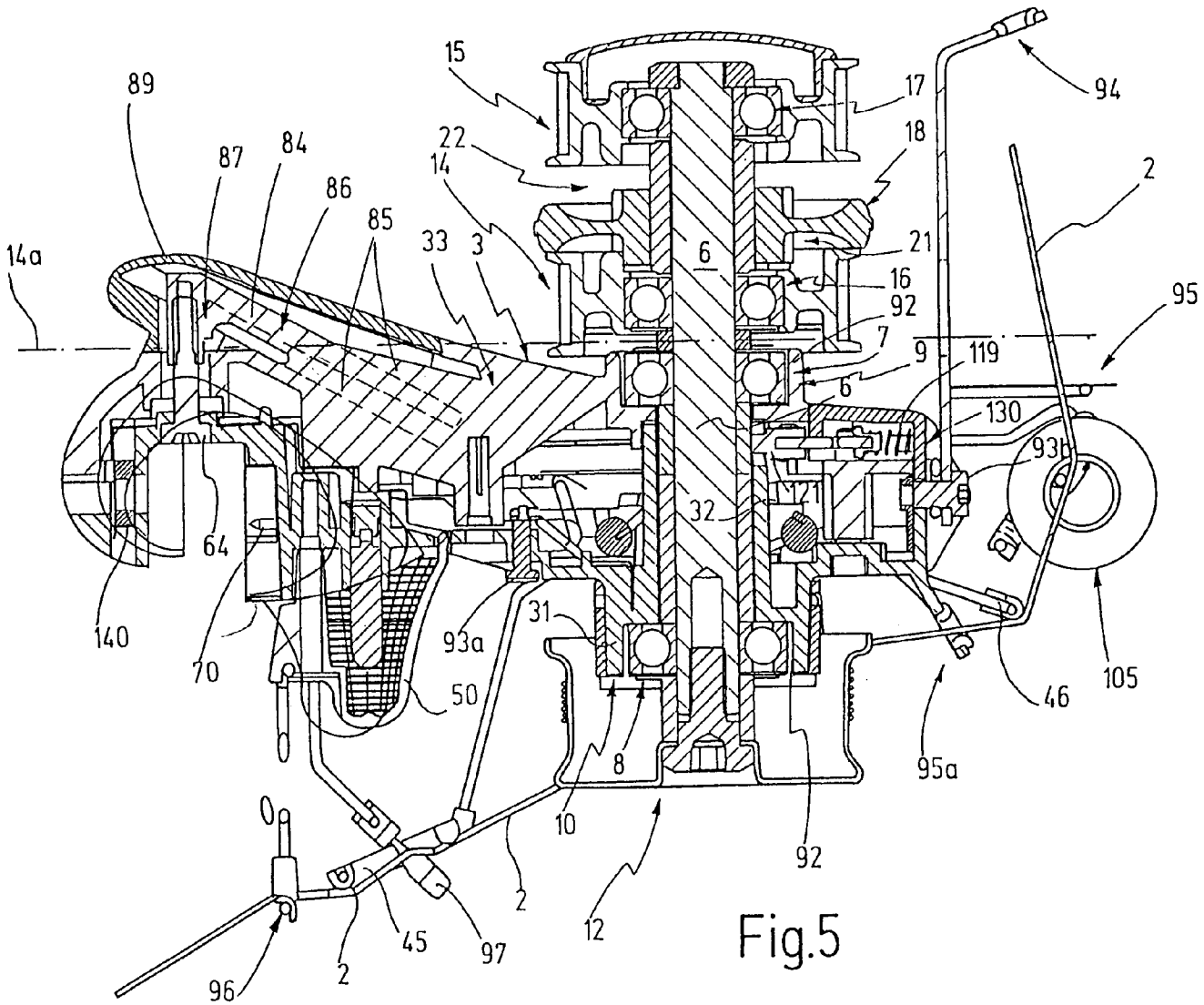
FIG. 5 is an enlarged vertical section of the yarn feeder shown in FIG. 4.

As shown in FIG. 5 (in conjunction with a slightly modified embodiment), a vertically disposed shaft 6 is rotatably supported in the housing 3. For bearing purposes, two ball bearings 7, 8 are used, which are held in respective bearing seats 9, 10 of the housing 3.

The shaft 6 on its lower end has a yarn guide drum 12, around which the yarn 2 is wrapped once or multiple times. The yarn guide drum 12 is carried and driven by the shaft 6. To that end, the shaft 6 on its upper end has one or more toothed-belt pulleys 14, 15, which in this case are rotatably supported on the shaft 6 by ball bearings 16, 17.

The toothed-belt pulley 14 meshes with the belt 5*a*, whose lower edge is depicted in FIG. 5 by a dot-dashed line 14*a*. Between the toothed-belt pulleys 14, 15, a displaceable coupling disk 18 is disposed. On both of its flat sides, the disk has toothed coupling rings 21, 22, with which the toothed-belt pulleys 14, 15 can be coupled alternatively with the shaft 6 and thus serve as a drive device for the shaft. The coupling disk 18 is provided with coupling prongs for this purpose.

Figure 9:
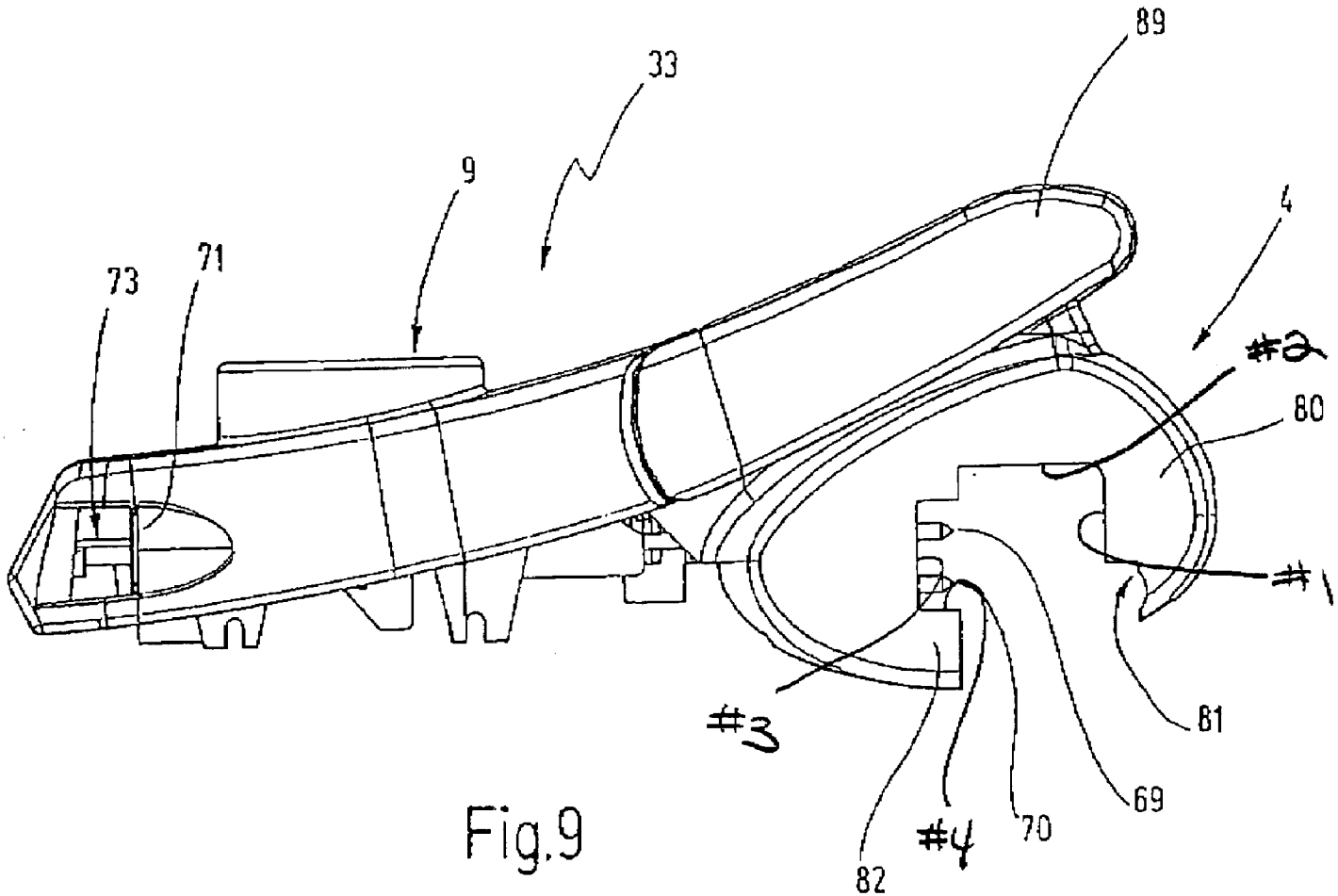
FIG. 9 is an end view of the yarn feeder housing.

The housing 3 is preferably constructed in multiple parts. In that case it first has a lower housing part 25, which is shown separately in FIGS. 6 and 7. The housing part 25 is a substantially clamshell-like injection molded part. For forming the fastening device 4, the housing part 25 has a portion 26 in the form of a U in side view, whose jaw opens downward and whose inner contour is adapted for receiving a fastening rail (retaining device) on the machine. On the legs 26*a* that define the jaw, lateral protrusions 27 are provided for transmitting an outward-oriented force, which spreads the jaw wider, to the other mating housing part 33. Thus the leg 26*a* is the leg that is primarily supported on the retaining device and in turn on a corresponding leg of the housing part 33 (FIG. 9). On the opposite side of the jaw, the conditions are reversed. The leg 26*b* on that side is supported secondarily, or in other words indirectly on the retaining device. Support cleats 28 act as abutments for corresponding parts (82, FIG. 9) of the corresponding leg of the housing part 33, which comes directly (primarily) into contact with the retaining device.

Figure 8:
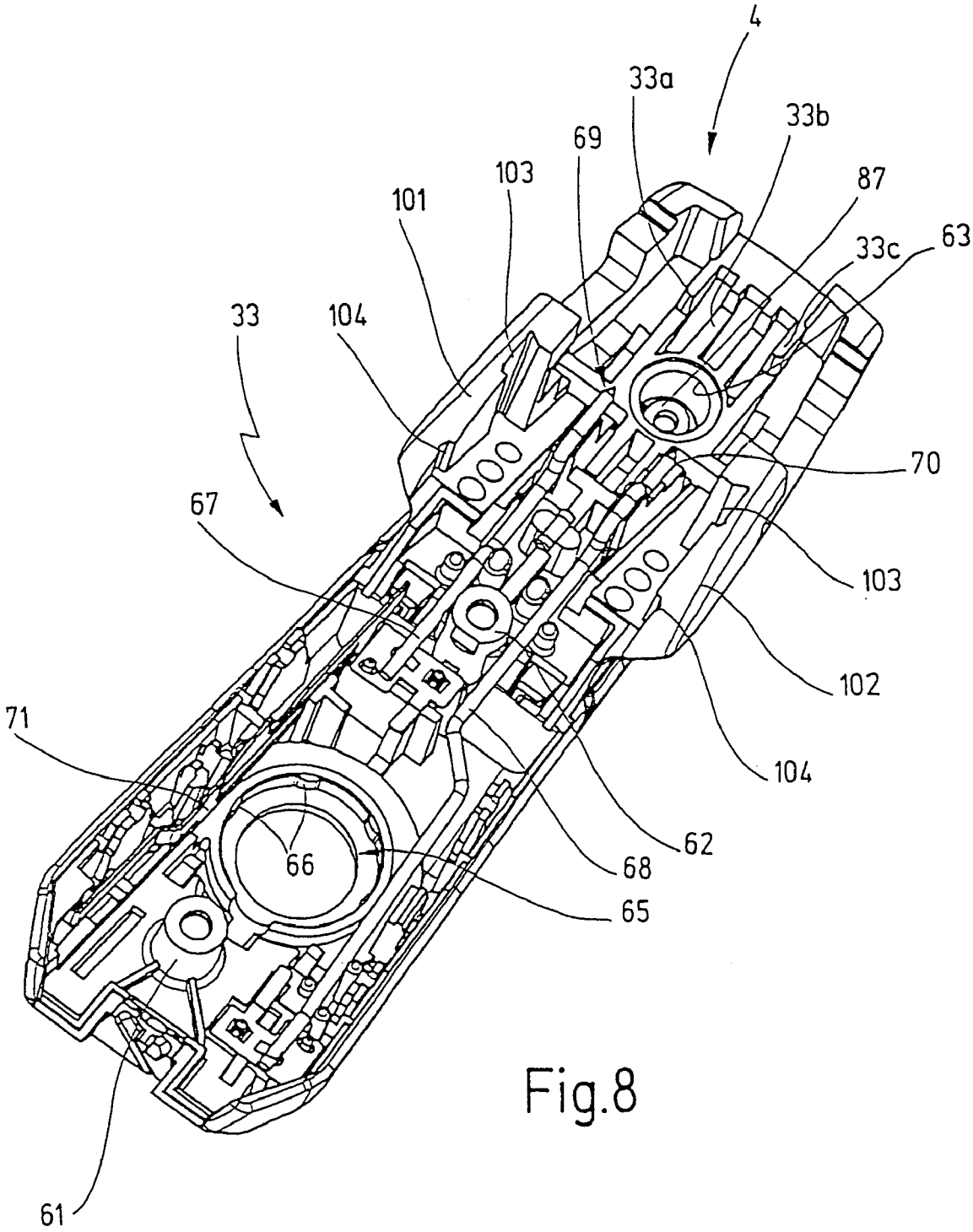
FIG. 8 is a perspective of a second or upper housing part of the yarn feeder such as shown in FIGS. 1 and 3.
Figure 10:
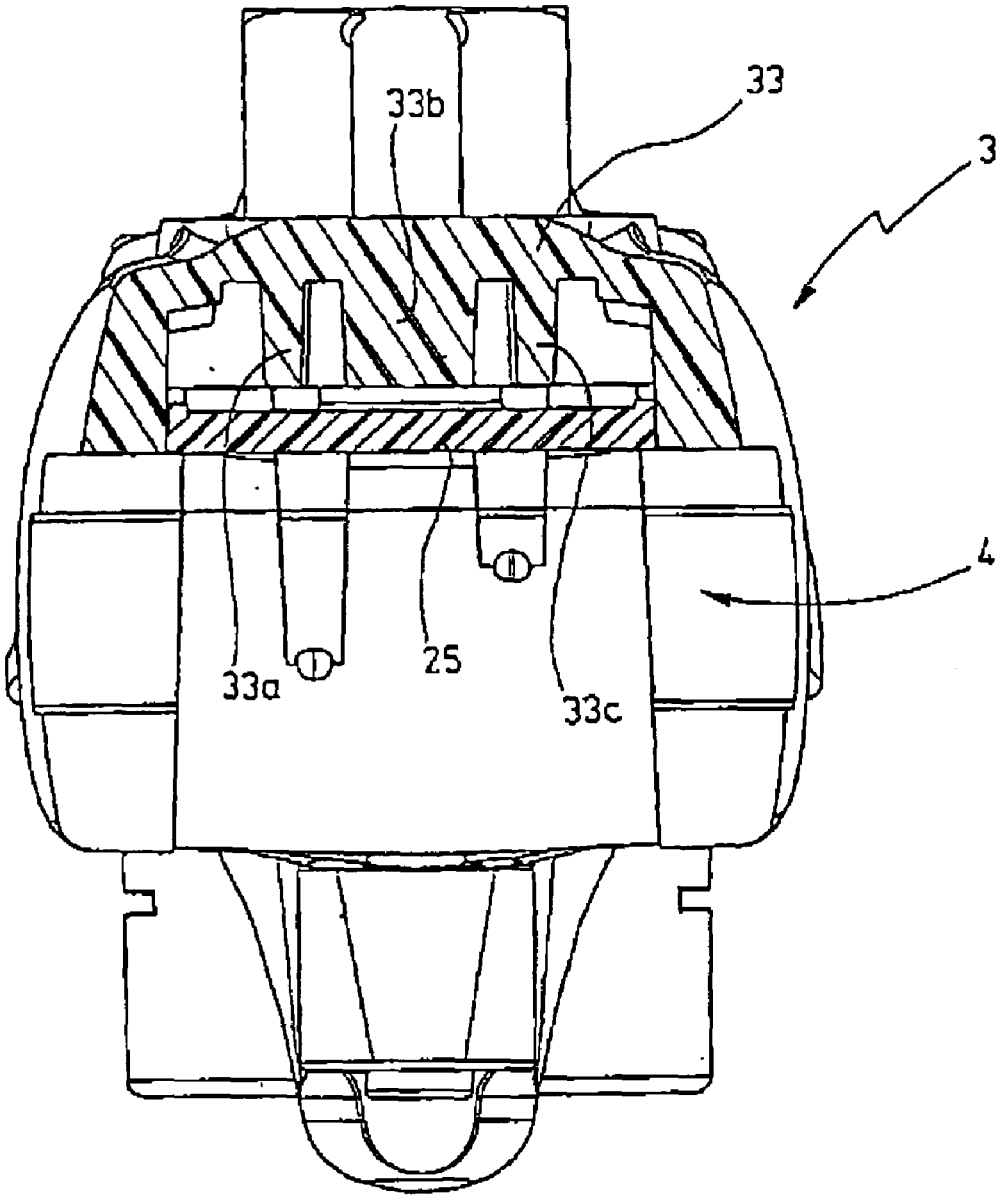
FIG. 10 is a side elevational view of the housing of the yarn feeder, shown in partial section in the region of the fastening clamp thereof.

The fastening device 4 is formed on the housing 3 as a fastening clamp by the housing 3; for that purpose, no force-carrying elements, reinforcing elements or the like of any kind made of material extraneous to the housing are provided. The cross section of the housing 3 in the region of the fastening device 4 can be seen in FIG. 10. The upper housing part 33 and the lower housing part 25 together define a hollow profile, approximating a box profile. The housing can be put together in such a way that the housing part 25, which in the section shown in FIG. 10 is approximately flat, has the upper housing part 33, which here is U-shaped fitting over it. in the interior enclosed by them, reinforcement ribs 33*a*, 33*b*, 33*c* can be provided. As needed, these ribs can also fill the interior almost entirely or entirely. However, relatively narrow ribs, of the kind also seen in FIG. 8, are preferred. The somewhat wider middle rib 33*b* can, as seen in FIG. 8, in turn be divided into ribs, so that an overly large plastic volume does not occur at any point of the housing part 33. Excessively great material thickness can thus be avoided.

Figure 3:
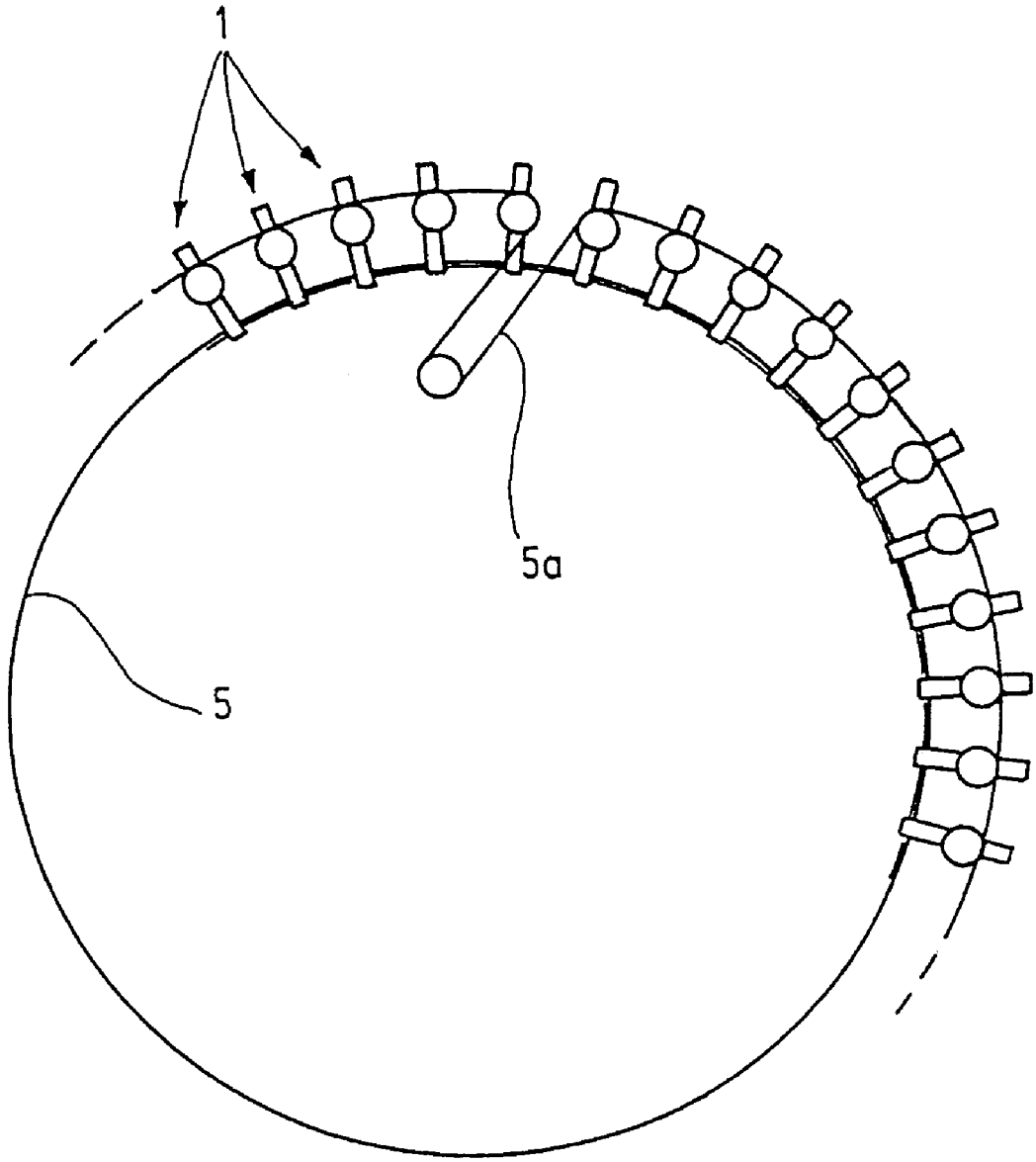
FIG. 3 is a diagrammatic depiction of a plurality of yarn feeders, such as shown in FIGS. 1 and 2, disposed on a retaining ring of a textile machine.

The hollow profile-like embodiment of the clamp, formed by the two housing parts 25, 33, and the optionally provided inner ribs 33*a*, 33*b*, 33*c* assure adequate rigidity of the fastening device 4 with respect to forces which have a tendency to spread the jaw wider. The fastening device 4 can thus be made so narrow that it does not protrude laterally past the yarn feeder, or does so at most only slightly, so that as shown in FIG. 3 the yarn feeders 1 have space side by side on the retaining ring 5.

On its underside, the clamshell-like housing part 25 has a tubular extension 31, which in the inside forms the bearing seat 10. In the opposite direction, a further tubular attachment 32 extends through the interior of the housing 3 vertically upward in order to align the housing part 25 with respect to a second, upper housing part 33. For further alignment, two pegs 34, 35 adjacent to the tubular attachment 32 are used, which protrude vertically upward from the bottom of the housing part 25. In the region of the fastening device 4, a further peg 36 is provided, which furthermore has an opening for a fastening screw.

Figure 6:
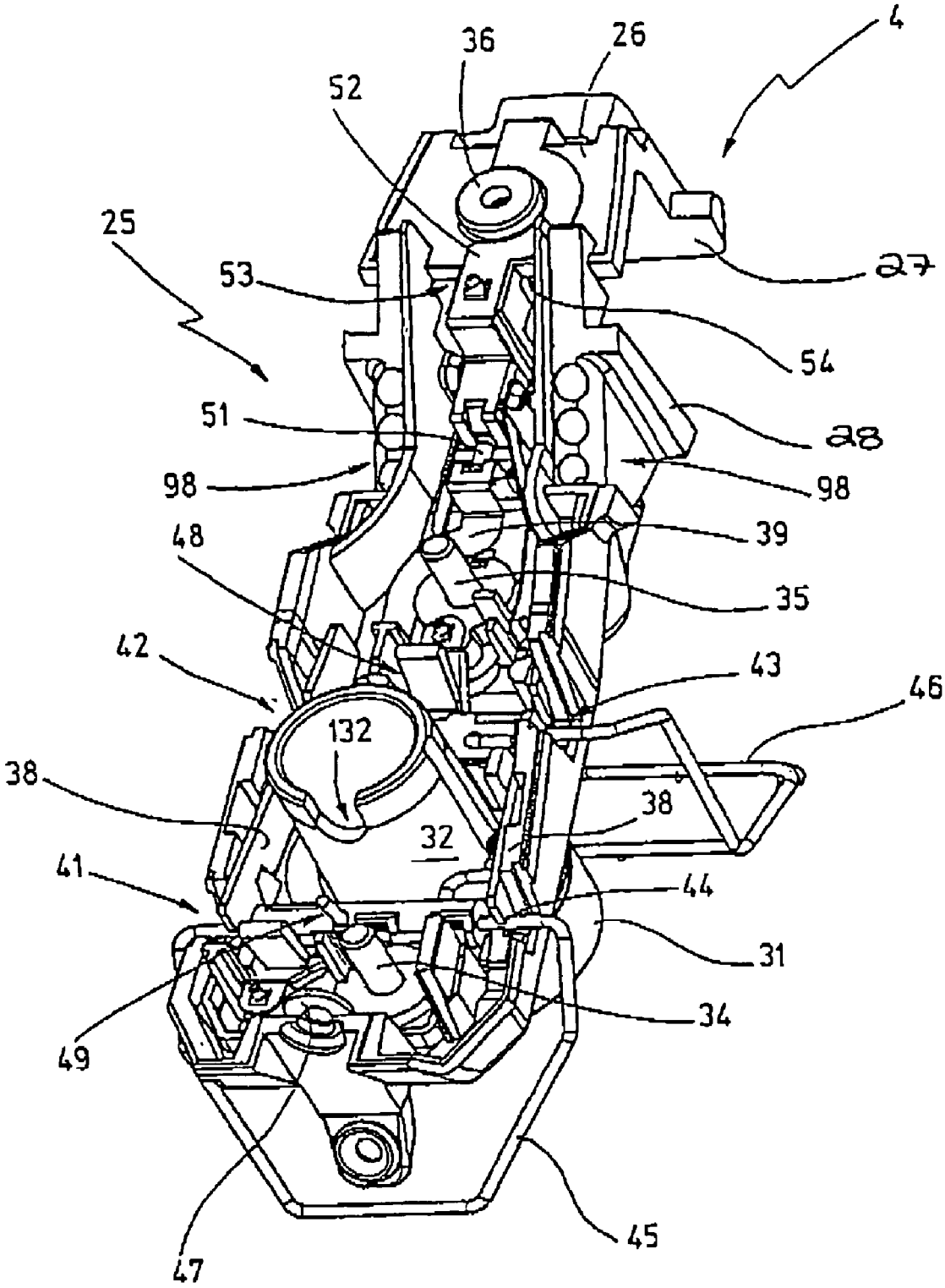
FIG. 6 is a perspective of a first or lower housing part of a yarn feeder such as shown in FIG. 1 or 3.
Figure 7:
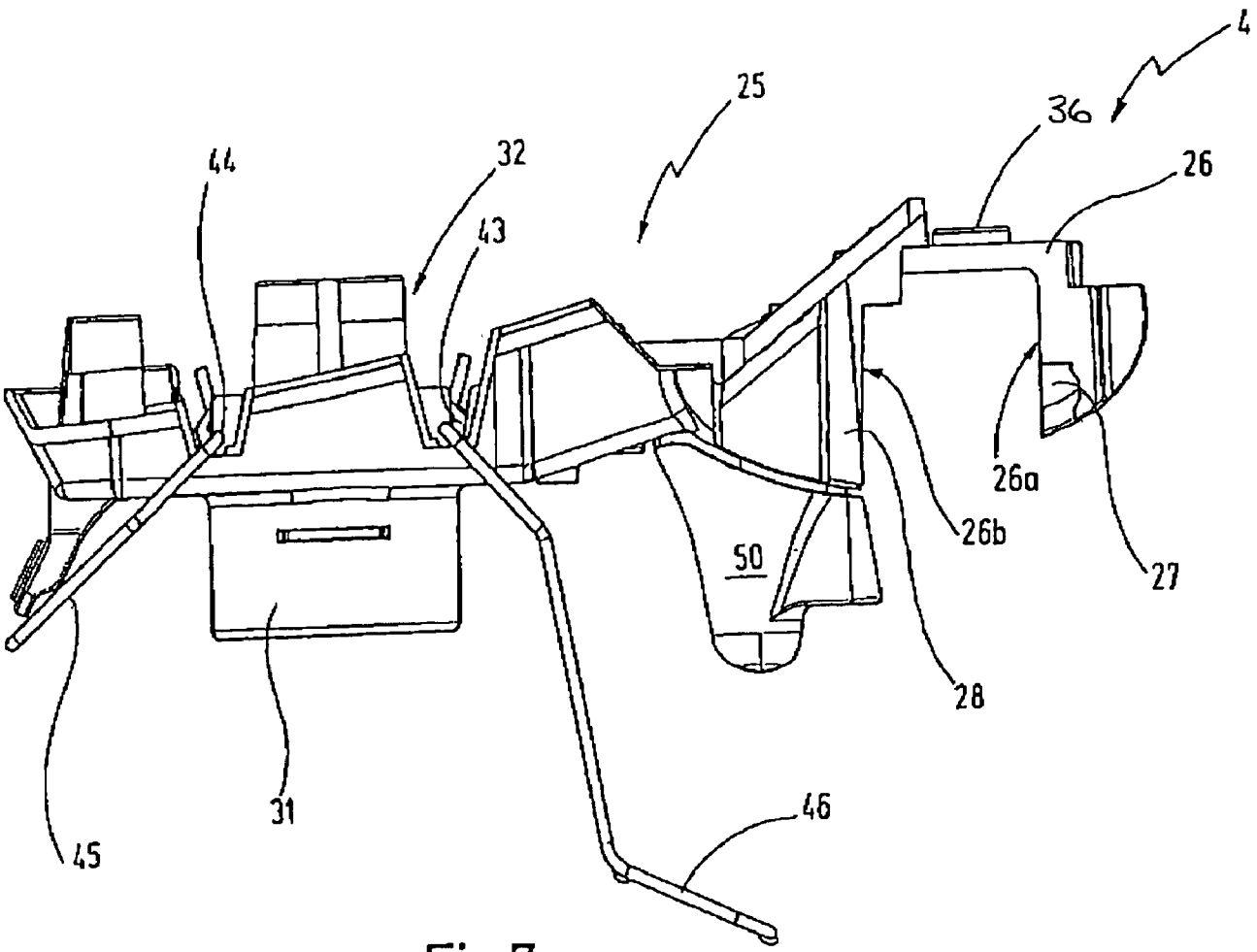
FIG. 7 is a side view of the housing part shown in FIG. 6.

As seen from FIG. 6, at least two metal strips 38, 39, are placed in suitable receptacles in the housing part 25 and are retained in corresponding slits. The metal strip 38, which is in the form of a U-shaped hoop, is for instance connected to ground potential and has notches 41, 42, 43, 44 for the pivotable bearing of an inlet-side yarn feeler 45 and an outlet-side yarn feeler 46 and also has an eyelet 47, in order to make a ground connection with external fixtures. This connection is made particularly with fixtures that come into contact with the yarn 2. Other stationary or moving yarn guide elements may, but need not, be grounded.

The metal strip 39 may lead to switches 48, 49, actuated by the yarn feelers 45, 46, of two separate shutoff current circuits. On its end remote from the switches 48, 49, the strip may define a clamp contact for an electronic component 51. This component may in turn be connected by its other end to a clamp contact of a further conductor 52. For contacting a line provided on the retainer on the machine, windows 53, 54 extending in the region of the fastening device 4 into the housing interior are provided, through which connection elements can reach. In the vicinity of the fastening device, a single indicator light 50 for both shutoff current circuits is disposed, which lights up as soon as one of the switches 48, 49 is actuated, or in other words as soon as one of the yarn sensors has been pivoted downward. The indicator light is inserted into a stamped conductor track.

The upper housing part 33, as depicted in FIGS. 8 and 9 has a clamshell shape and in its interior, it has hollow pegs 61, 62 for receiving the pegs 34, 35 of the lower housing part 25. A recess 63 of circular cross section is provided for receiving the hollow peg 36, and a threaded bore for a fastening screw 64 (see FIG. 5) is provided on its bottom. The bottom is formed, as will be explained hereinafter, by a part of a coupling device. For adjusting the housing parts 33, 25, and particularly to attain adequate alignment of the ball bearings 7, 8 with one another, a suitable seat is embodied in the housing part 33 in order to receive the tubular extension 32. This seat is formed substantially by a stepped bore which is capable of receiving the upper end, formed somewhat conically if needed, to the tubular extension 32. For low-play or play-free centering of the free end of the extension 32, axially oriented ribs 66 may be disposed on the circumference of the approximately cylindrical outer surface of the seat 65. On the outside of the housing part 33, the bearing seat 9 is embodied, coaxially to the seat 65 on the inside.

Also embodied in the upper housing part 33 are receptacles for electrical contact means, such as two electrical conductors 67, 68, which have ends 69, 70 tapering to a point. The ends 69, 70 protrude into the region of the fastening device 4 and are disposed and retained in such a way that they protrude through the windows 53, 54 (FIG. 6) as can be seen particularly from FIG. 8 or FIG. 4. The contact with the contact strips of the lower housing part 25 is made automatically when the housing 3 is put together, for instance in that these strips press resiliently against the conductors 67, 68.

In the housing 3, and in the present exemplary embodiment in the housing part 33, a feeler barrier 71 is supported longitudinally displaceably as can be seen from FIGS. 1, 8 and 9. It is formed by a sheet-metal strip whose free end, embodied as a handle 72, protrudes out of the housing part 33. To that end, a depression 73 visible in FIG. 1 is formed in the housing part 33, and an angled end of the feeler barrier 71 is disposed in the depression. The feeler barrier 71 is displaceably supported and is profiled in such a way that it pivots first one feeler lever (45) and then the other feeler lever (46) from a freely downward-hanging position into an upper position upon actuation.

Figure 12:
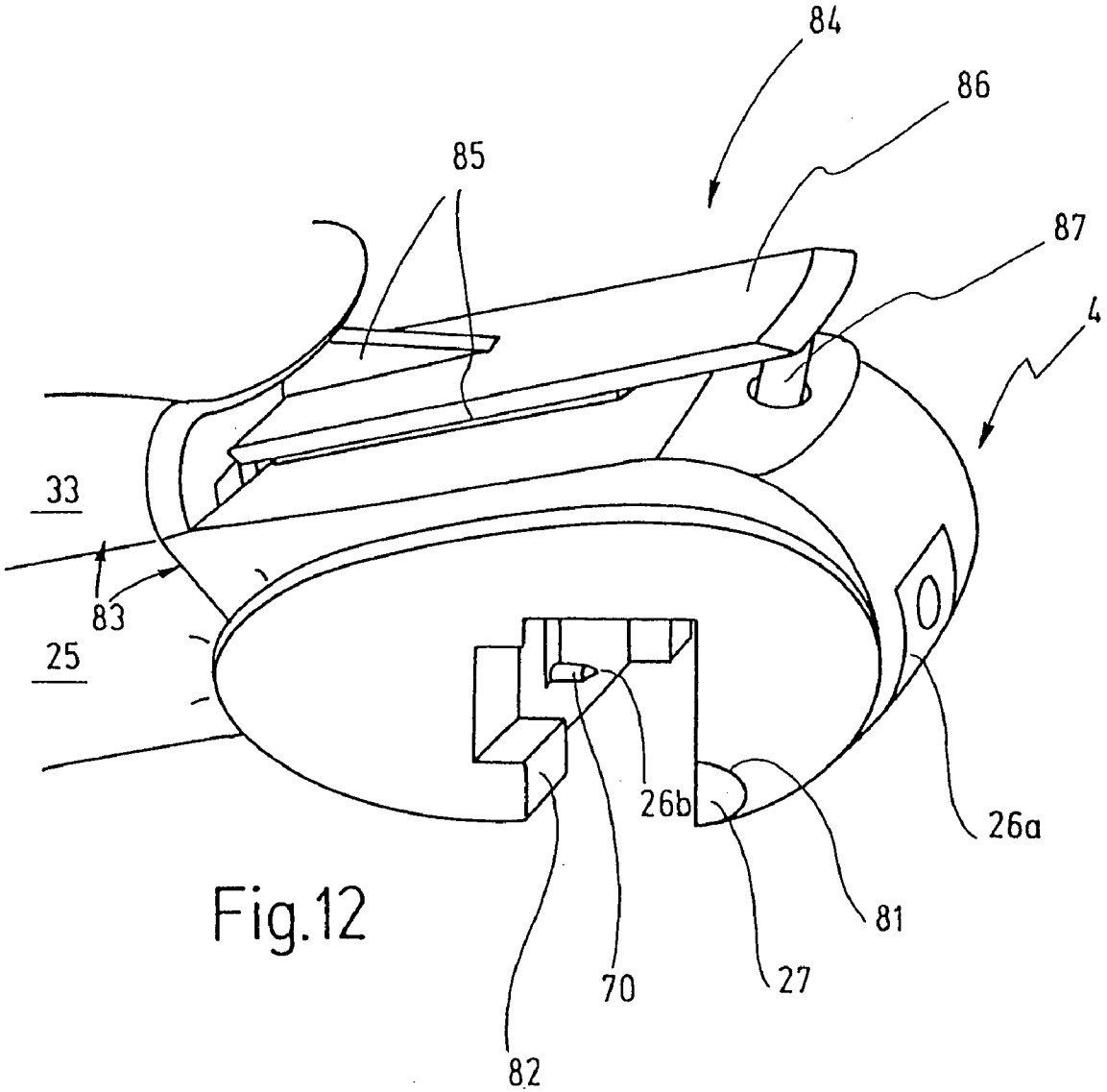
FIG. 12 is a perspective of a coupling clamping device for fastening fixtures to the yarn feeder.

As seen particularly from FIG. 9 and FIG. 12, a jaw-like portion 80 of the fastening device housing part 33 can fit over the portion 26 of the lower housing part 25. It has a rear bearing depression 81, into which the protrusions 27 (FIG. 7) of the lower housing part 25 can move. On the opposite side, conversely, a bearing region 82 is formed, which is braced on the support cleats 28 of the lower housing part 25, when it is urged in the region that stretches the jaw open.

Figure 4:
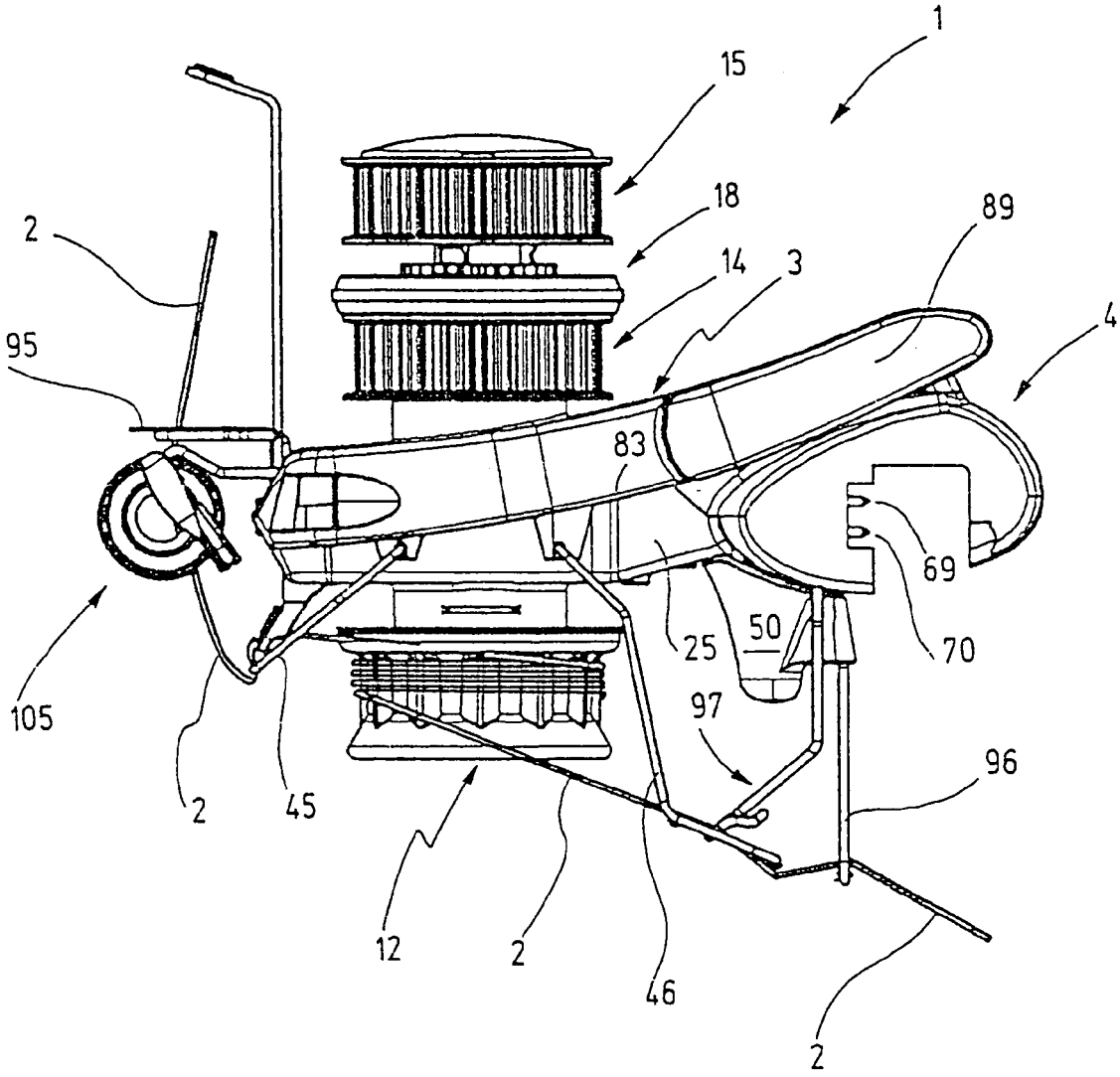
FIG. 4 is a side elevational view of an alternative embodiment of yarn feeder embodying the present invention.
Figure 13:
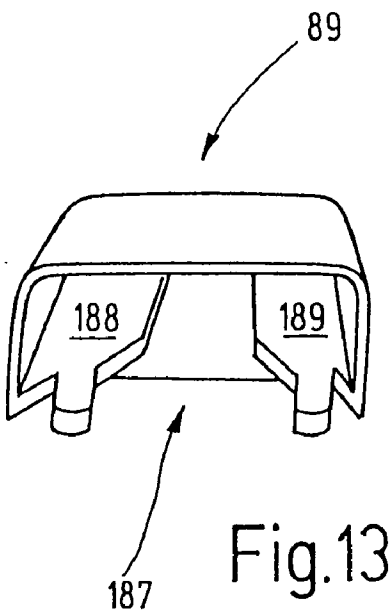
FIG. 13 is a perspective of a cover cap for the coupling device shown in FIG. 12.

Between the housing parts 25, 33, an approximately horizontal dividing seam 83 is formed. The housing parts 25, 33 fit in one another here. Approximately in a rectilinear extension of the dividing seam 83, in the region of the fastening device 4, a coupling clamping device 84 is formed, which is shown separately in FIG. 12 as a component of the upper housing part 33. It is formed by a flat guide plate 86, connected to the housing part via ribs 85, and its free end has a female-threaded hollow peg 87, which forms the bottom of the recess 63. The hollow peg 87 is carried by the guide plate 86 and protrudes freely into the recess 63. The fastening screw 64 is seated in the hollow peg 37 and holds the two housing parts 25, 33 together, and once it is tightened it deforms the guide plate 85 somewhat. A foot 187, slipped onto the guide plate and having a shape complimentary to the guide plate is firmly clamped thereby. The foot 187 has two cleats 188, 189, which fit with little play into the interstice between the guide plate and the adjacent housing face. When the guide plate 86 is deformed, the foot 187 clamps. In FIG. 4 and FIG. 9, a cover cap 89 is thereby retained; this cap being shown separately in FIG. 13. As needed, however, this cap can be removed and replaced with a retaining hoop 90, as shown in FIG. 1 or FIG. 2. By way of example, the retaining hoop can carry yarn guide means, such as a tubule 91. The retainer hoop 90 can fit over the toothed-belt pulleys 14, 15 with its clamping retainer being disposed in the immediate vicinity of the fastening 4.

For secure fastening of the ball bearings 7, 8 and the bearing seats 9, 10, elastomer elements are disposed between the respective ball bearings 7, 8 and the bearing seat 9, 10. The bearing seats 9, 10 are preferably provided on the inside with longitudinal ribs or regions protruding in other ways, so that the elastomer elements, in the region off the longitudinal ribs, are compressed somewhat between the outer bearing ring and the rib. The elastomer elements have a compensatory effect for temperature changes, shrinking from aging, and production variations.

The housing parts 25, 33 are held against one another by the fastening screw 64 and by other fastening screws 93*a*, 93*b*. These fastening screws 93*a*, 93*b* can also serve to hold further elements, such as yarn guiding elements 94 or a knot catcher 95 (see FIG. 5) against the housing 3, the knot catcher being electrically connected to the eyelet 47 of the grounded metal strip 33. Immediately upstream of the yarn guide drum 12, a further yarn guide 95*a* may be provided, which is retained against an extension of the lower housing part 25. Following the yarn guide drum, further yarn guide elements 96, 97 may be disposed.

While the yarn guide element 96 is embodied as a hook and is retained non-displaceably, the yarn guide eyelet 97 may be adjustable, as an antifilamentation device. For instance, the yarn guide eyelet 97 may be embodied as a wire hoop, whose two ends have a foot that is displaceably supported on the housing 3. To that end, the lower housing part has one pocket 98, visible in FIG. 6, on both sides, the pocket having vertical end faces. The upper housing part 33 (FIG. 8) has cheeks 101, 102, which are associated with the pockets 98 and are profiled on their inside in such a way that on both sides of the pockets 98 they have guide grooves 103, 104, into which the wire hoop can snap. For adjustment purposes, the hoop can thus be compressed and transferred out of the guide groove 103 into the guide groove 104, and vice versa. The lower free end of the hoop, forming an eyelet, can thus be transferred from a first position, in which it is located virtually at the same level as the lower rim of the yarn guide drum but spaced apart from this drum, to a second position in which it is located relatively far below the lower rim but horizontally closer to it.

Figure 11:
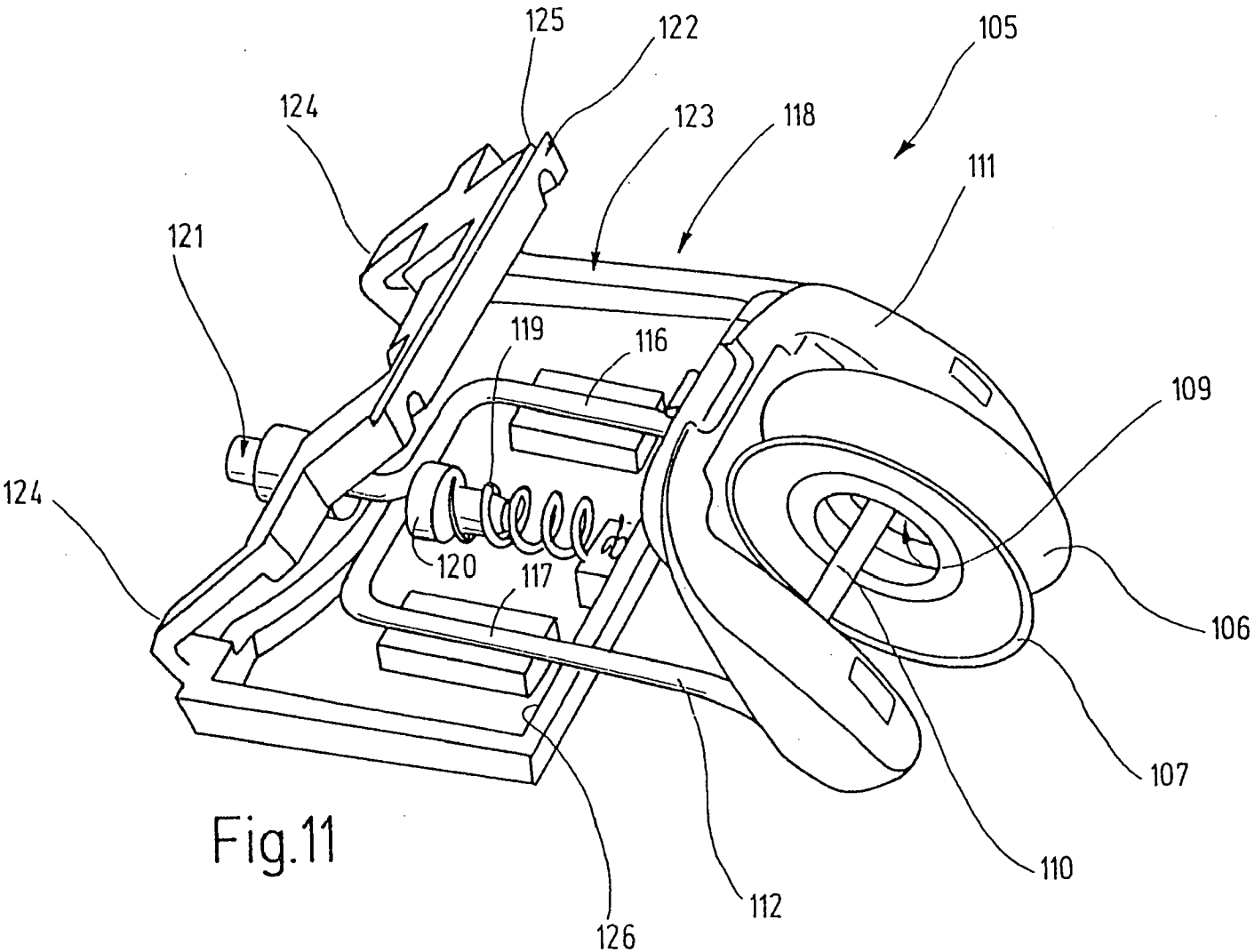
FIG. 11 is a perspective of a yarn brake adapted for mounting on the housing of the illustrated yarn feeder.

Optionally, a yarn brake 105, which may be driven, is provided on the yarn feeder 1. As needed, a non-driven yarn brake can also be provided. The yarn brake 105 has two rings 106, 107, visible particularly from FIG. 11, which each have one inner and one outer rim; the rims of the two rings 106, 107 are curved away from one another. Permanent magnets urge the rings 106, 107 elastically against one another.

The rings 106, 107 have a relatively large central opening 109, through which a wire rib 110 extends. This wire rib is supported in a plastic guide element 111, which is locked with a wire hoop 112 and has a leg extending below the rings 106, 107 (in FIG. 11, the yarn brake 105 is shown standing on its head).

The wire hoop 112 has two hoops 116, 117, which carry the guide element 111 and the rings 106, 107. The legs are supported longitudinally displaceably in a guide part 118. The leg 117 has an end bent inward, that is, toward the rings 106, 107, on which end an intermediate element 120 is held, being braced on the guide element 118 via a helical spring 119 or other kind of spring. The other leg 116 is approximately aligned with the free end of the leg 117 but is bent away from it. The end has a tappet 121, which also may be formed by a cap-shaped plastic part.

The guide element 118 is preferably a plastic element, with a base 122 and a cap 123 that are joined together via a film hinge 124. Detent means, in the form of a rib 125 embodied on the free end of the base 122 and an undercut 126 embodied on the cap 123, allow the base 122 and cap 123 to be secured to one another. This fixes the hoop 112 in such a way that it is now only axially displaceable and otherwise is retained. The yarn brake 105 is thus a fixture module that is simple to put together and connect.

For receiving the thus-formed brake unit, a pocket 130 is formed on the housing 3, preferably on the upper housing part 33. This pocket may be provided with guides, so that the yarn brake 105 can be introduced into this pocket in guided fashion like a drawer. The fastening screw 93*b* can act as a securing means that prevents the brake unit from sliding out of the pocket. Alternatively, detent means may be provided.

As seen from FIG. 5, the tappet 121 reaches through a recess 132 (see FIG. 6) provided in the extension 32. A protrusion or cam, not shown in detail, provided on the shaft 6 can be disposed in such a way that upon each revolution of the shaft 6, it transmits a pulse to the tappet 121 and thus to the yarn brake 105. Alternatively, a reducing gear or a shifting gear, similar to a speedometer drive, may be disposed between the shaft 6 and the cam, in order to transmit one pulse to the yarn brake 105 after only a fixed number of revolutions of the shaft 6.

The yarn feeder 1 described thus far functions as follows:

In operation, the yarn feeder is secured to a yarn-using machine. To that end, the fastening device 4 is mounted on a retaining ring, and a screw, not shown further in FIG. 5, seated in a nut 140 is tightened. In this process, the ends 69, 70 (FIG. 4) tapering to a point penetrate the insulation of an electrical line, laid along the retaining ring, and make electrical contact with it. The fastening device 4 is also tightly seated on the retaining ring. The two housing parts 25, 33 fitting in one another in the region of the fastening device 4 mutually support one another, so that both of them are equally tightly fastened on the retaining device. A belt is now placed on at least one of the pulleys 14, 15; the applicable pulley is coupled to the shaft 6, and a yarn is drawn in. The yarn is guided by the yarn inlet eyelets of FIG. 5 or a yarn tubule of FIG. 1 and FIG. 2 to the knot catcher 95 and the yarn brake 105. Here the yarn is clamped between the two rings 106, 107 and then travels via the yarn feeler lever 46 and optionally the yarn eyelet 95*a* to the yarn guide drum 12. The yarn 2 wraps around this drum once or multiple times, and the yarn 2 then travels, sweeping over the lower rim of the drum 12, to the adjustable yarn guide hoop 97. After passing this hoop, the yarn travels to the outlet eyelet 96. Between the outlet eyelet 96 and the yarn guide hoop 97, the yarn tension feeler 45 rests on the yarn. The introduction of the yarn can be facilitated if the feeler barrier 71 is actuated before the yarn 2 is drawn in; transfers both yarn feelers 45, 46 to their upper, raised position. After the yarn has been drawn in, the feeler barrier is undone by means of the handle 72 (see, e.g. FIGS. 1 and 2), and as a result the yarn feelers 45, 46 move downward by their own weight and rest on the yarn 2.

In operation, the yarn guide drum 12 is driven to rotate and draws yarn off via the yarn brake 105. The yarn is fed positively to the textile machine and in the process runs along the lower rim of the drum. The yarn tension in this operation is so great at the two yarn feelers 45, 46 that both feeler levers are in a raised position. Correspondingly, the switches 48, 49 accommodated in the housing are not actuated, and the signal light 50 mounted visibly from all sides on the housing 3 remains dark. However, if one of the yarn feelers 45, 46 drops downward because of a tear in the yarn, then the signal light 50 receives current and lights up. In FIG. 4, this is shown for the yarn feeler 45. It is assumed that at the knot catcher 95 a yarn tear has occurred, so that the yarn is interrupted and the torn-off end of the yarn 2 is just now leaving the yarn brake 105. The yarn feeler 46 therefore drops downward, and as a result the switch 49 responds and appropriate measures can be taken.

If needed, the yarn feeder 1 can be refitted, for instance by replacing the retainer 90 with the cover cap 89. To do so, the fastening screw 64 need merely be loosened somewhat, after which the retainer 90 or the cover cap 89 can be pulled off the coupling clamping device 84. After that, whichever is the other part is slipped onto the coupling clamping device 84 and tightened by tightening the fastening screw 64. The yarn feeder 1 can also be repositioned in a simple way with regard to drawing off yarn. The position of the yarn guide hoop 97 can then be adjusted in such a way that the yarn is pulled more or less via the lower rim of yarn guide drum 12. It can be adjusted along a path on which at the same time both the level off the yarn guide hoop and its spacing from the pivot axis of the shaft 6 can be varied. The adjusting device is formed by an approximately linear guide with an acute-angled orientation of 30 to 40 degrees from the pivot axis of the shaft 6.

Figure 14:
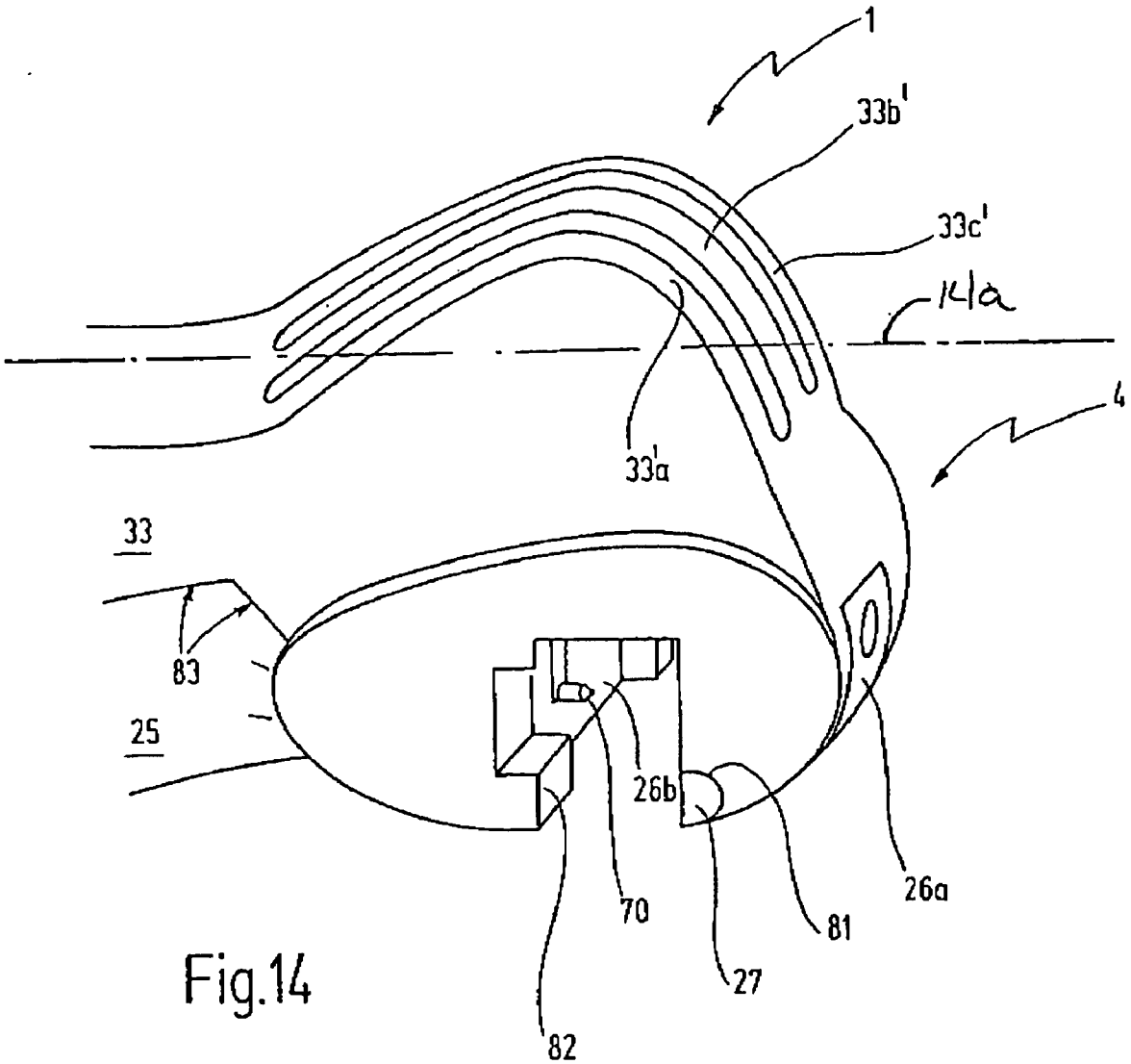
FIG. 14 is a perspective of an alternative embodiment of fastening device for the yarn feeder.

A modified embodiment of the yarn feeder 1 is shown in FIG. 14. It differs from the above-described yarn feeder 1 in terms of the embodiment of the fastening device 4. The fastening device is provided, on the side remote from the jaw, with reinforcing ribs 33*a*', 33*b*', 33*c*', which belong to the housing part 33 and whose special feature is that they protrude from the level that is defined by the lower edge of the drive belt as indicated by the dot-dashed lines 14*a* in FIG. 14. The wall thickness of the ribs 33*a*', 33*b*, 33*c*' is overly great and is substantially less than their respective height. This makes the fastening device 4 so resistant to widening forces that it is possible to dispense with introduction elements, metal inlays or other stiffening additional elements in the clamp. Only the nut 140 visible in FIG. 5 is needed. Other metal elements can be omitted.

From the foregoing, it can be seen that the yarn feeder 1 of the invention has a plastic housing 3, preferably made of two clamshells. For connection to a retainer on the machine, a fastening device 4 is provided that also is made of plastic. The fastening device 4 is made rigid by suitable shaping which may eliminate the necessity for metal inlays. The two halves of the housing each have one bearing for a continuous shaft, which on one end carries a yarn guide drum and on its other end carries pulleys 14, 15, for instance, as a drive device. Fastening means serve to hold the two housing parts together in the correct position. The housing 3 is easy to open for maintenance purposes.

What is claimed is:

1. A yarn feeder (1) particularly adapted for use in textile machines comprising:

a housing (3) having a plastic fastening clamp (4) for fastening to a retaining device of a textile machine;

a shaft (6) extending through said housing (3);

a yarn guide drum (12) mounted adjacent an end of said shaft;

a drive for rotating said shaft and yarn guide drum; said drive including at least one drive pulley (14) carried on said shaft and a drive belt for driving said drive pulley, said at least one drive pulley and drive belt being in spaced relation to one side of said yarn guide drum; and said fastening clamp (4) having portions (33*a*' 33*b*, 33*c*') extending through and beyond a plane defined by a rim of the drive pulley that engages an edge of the drive belt on a yarn guide drum side of the belt.

2. The yarn feeder of claim 1 in which said fastening clamp (4) has a jaw for receiving the retaining device on the textile machine.

3. The yarn feeder of claim 2 in which said housing is in two parts, and said jaw is formed on one of the housing parts (25, 33).

4. The yarn feeder of claim 3 in which the housing parts (25, 33) fit over one another in the region of the fastening clamp (4), and said housing parts (25, 33) are joined together by at least one support (27, 28) in the region of the fastening device (4).

5. The yarn feeder of claim 1 including a coupling device (86) disposed above the fastening clamp (4) for connecting a further component (89, 90) onto the housing.

6. The yarn feeder of claim 1 in which the housing (3) has receptacles into which metal elements (38, 39) are disposed and which serve as conductor tracks for electrical components associated with the yarn feeder.

7. A yarn feeder (1) particularly adapted for use in textile machines comprising:

a housing (3) having a fastening clamp (4) for fastening to a retaining device of a textile machine;

a shaft (6) extending substantially vertically through said housing (3), a yarn guide drum (4) mounted adjacent an end of said shaft, a drive device (14) connected to another end of said shaft;

yarn guides (95*a*, 97) for defining a yarn travel path toward and away from the yarn guide drum (12);

at least two bearings (7, 8) for rotatably supporting said shaft (6);

said housing (3) having at least one first housing part (25) oriented toward said yarn guide drum (12) and having a bearing seat (10) for one of said bearings (8);

said housing (3) having at least one second housing part (33) oriented toward the drive device (14) and having a seat for the other bearing (7);

at least one connector (64) for connecting the housing parts (25, 33) together in properly positioned relation;

said housing (3) having a substantially horizontal dividing seam (83) between said housing parts (25, 33), and said housing parts (25, 33) have alignment members (32, 34, 35) which locate the housing parts (25, 33) in proper positionable relation to each other; and wherein said bearings (7, 8) are ball bearings and said bearing seats (9, 10) are tubular members pointing away from each other, each tubular member being integrally formed in a respective one of the housing parts (25, 33).

8. The yarn feeder of claim 7 in which one of said tubular portions is oriented toward the yarn guide drum (12) and extends into an interior defined by the yarn guide drum (12).

9. The yarn feeder of claim 7 including bearing receiving elements disposed between the bearing seats (9, 10) and the bearings (7, 8), and said bearing seats (9, 10) have interrupted bearing faces protruding radially inward in the direction toward the bearings (7, 8).

10. The yarn feeder of claim 7 in which said fastening clamp (4) has a jaw for receiving the retaining device on the textile machine.

11. The yarn feeder of claim 7 in which said housing is made of plastic.

12. The yarn feeder of claim 11 in which an electrically grounded conductor is disposed within the housing and is connected to at least one metal element (95) that is in contact with yarn being fed by the yarn feeder.

13. The yarn feeder of claim 12 including movable sensor elements (45) that are supported on the at least one metal element.

* * * * *